United States Patent [19]

Kirk et al.

[11] Patent Number: 4,583,865

[45] Date of Patent: Apr. 22, 1986

[54] REAL TIME CLOCK SYNCHRONIZATION

[75] Inventors: David L. Kirk; Robert L. Spiesman, both of Phoenix, Ariz.

[73] Assignee: Honeywell, Phoenix, Ariz.

[21] Appl. No.: 682,646

[22] Filed: Dec. 17, 1984

[51] Int. Cl.[4] ..... G04C 11/00; G04F 8/00

[52] U.S. Cl. ..... 368/46; 368/118

[58] Field of Search ..... 368/10, 46–52, 368/118; 455/70; 375/106, 107, 111

[56] References Cited

U.S. PATENT DOCUMENTS

| | | | |
|---|---|---|---|
| 4,040,247 | 8/1977 | Haydon | 368/156 |
| 4,234,958 | 11/1980 | Pipes et al. | 368/47 X |
| 4,322,831 | 3/1982 | Peterson | 368/46 |

*Primary Examiner*—Vit W. Miska

*Attorney, Agent, or Firm*—A. A. Sapelli; J. S. Solakian; A. Medved

[57] ABSTRACT

A method of synchronizing a digital timer with the frequency of a source of A.C. power to provide long term temporal stability. The timer produces internal, fine resolution, synchronization and real time timing signals from a source of clock signals. The periods of all the timer produced timing signals are integral multiples of the period of its internal timing signal.

A.C. reference timing signals which are a function of the frequency of the source of A.C. power are applied to the timer. The quotient of the period of the synchronization timing signals by that of the A.C. reference timing signals is an integer "n". Once n is determined, the number of fine resolution timing signals in each synchronization period for every $n^{th}$ A.C. timing signal is compared with a reference value. The timing of the fine resolution timing signals is adjusted to maintain the number of fine resolution timing signals in each synchronization period at which the $n^{th}$ A.C. reference timing signal is produced substantially equal to the reference value.

14 Claims, 5 Drawing Figures

REAL TIME CLOCK SYNCHRONIZATION

BACKGROUND OF THE INVENTION (1) Field of the Invention

This invention is in the field of methods of synchronizing a digital timer with the frequency of a source of A.C. electric power such as is provided by an electric utility.

(2) Description of the Prior Art

Digital timers which maintain current, or real time, time utilizing clock signals produced by crystal controlled oscillators, or clocks, are well know. Relatively low cost clocks of reasonable accuracy of ±0.05%, for example, are satisfactory for digital timers which are required to maintain real time over shorter periods of time, or where precise accuracy is not a requirement. Longer term stability of the clock signals applied to a digital timer can be achieved by using clocks which are more accurate, but the cost of achieving a significantly higher degree of accuracy over long periods of time, measured in weeks, months, or years, as is required in process control systems is significantly high. Thus, there is a need for a lower cost more reliable way to achieve long term stability with the desired degree of accuracy for digital timers using conventional reatively low cost digital clocks.

A very reliable source of real time timing information which is gnerally available is the frequency of A.C. electric power from public utilities. The utilities, over long periods of time maintain, or control, the accuracy of the frequency of the A.C. power such that it normally does not deviate by more than one cycle per second over long periods. Thus, the frequency of such an A.C. source is available as a timing reference at essentially no cost. However, there are two standard frequencies at which A.C. power is supplied, 60 cycle and 50 cycle. Thus a digital timer, or timing subsystem, that is to be used in equipment essentially worldwide must be able to synchronize itself with a source operating at either frequency if it is to use the frequency of such sources as a timing reference to obtain long term stablility with the desired degree of accuracy.

SUMMARY OF THE INVENTION

The present invention provides a method of synchronizing a digital timer with the frequency of a source of A.C. power to provide long term stability in accuracy to the real time maintained by the timer with the desired degree of accuracy. The timer produces internal, fine resolution, synchronization, and real time, timing signals, with the real time timing signals having a period of one second. The periods of each of the above timing signals is an integral multiple of the period of the clock signals produced by a crystal control oscillator, or clock. A.C. reference timing signals are produced which are a function of the frequency, 50 or 60 $H_z$ of the source of A.C. power for the timer. The relationship between the period of a synchronization Period and the period of an A.C. reference timing signal is that the quotient from dividing the synchronization period by the period of an A.C. reference timing signal is an integer "n". This is true whether the frequency of the source of A.C. power is 60 $H_z$ or 50 $H_z$. The only difference is in the value n. Upon initialization of the timer, the value of n is determined by counting the number of A.C. reference timing signals produced in a synchronization period. When the timer is thereafter commanded to synchronize on the frequency of the source of A.C. power, it identified and stores as a reference the number of fine resolution timing signals produced in the present synchronization timing period when the first A.C. reference timing signal is received after being so commanded. On the receipt of every $n^{th}$ A.C. reference timing signal thereafter, the number of fine resolution timing pulses in the then current synchronization timing period is compared with the reference. Depending on the sign and absolute value of the difference, adjustments are made in the timing of the fine resolution timing signals to minimize the difference. If the absolute value of the difference exceeds a predetermined magnitude an error condition is identified. Three error conditions in a single second causes the timer to stop synchronizing on the frequency of its source of A.C. power until again commanded to do so.

It is therefore an object of this invention to provide a method of synchronizing a digital timer to the frequency of a source A.C. electric power.

It is another object of this invention to provide a method of obtaining long term stability with the required degree of accuracy for the time information maintained by a digital timer.

It is yet another object of this invention to provide at minimum cost a method of providing long term stability with the desired degree of accuracy to a digital timer utilizing a source of clock signals, the stability and accuracy of which is less than that desired.

BRIEF DESCRIPTION OF THE DRAWINGS

Other objects, features and advantages of the invention will be readily apparent from the following description of certain perferred embodiments thereof taken in conjunction with the accompanying drawings, although variations and modifications may be affected without departing from the spirit and scope of the novel concepts of the disclosure and in which.

DESCRIPTION OF THE PREFERRED EMBODIMENT

Figure 1:
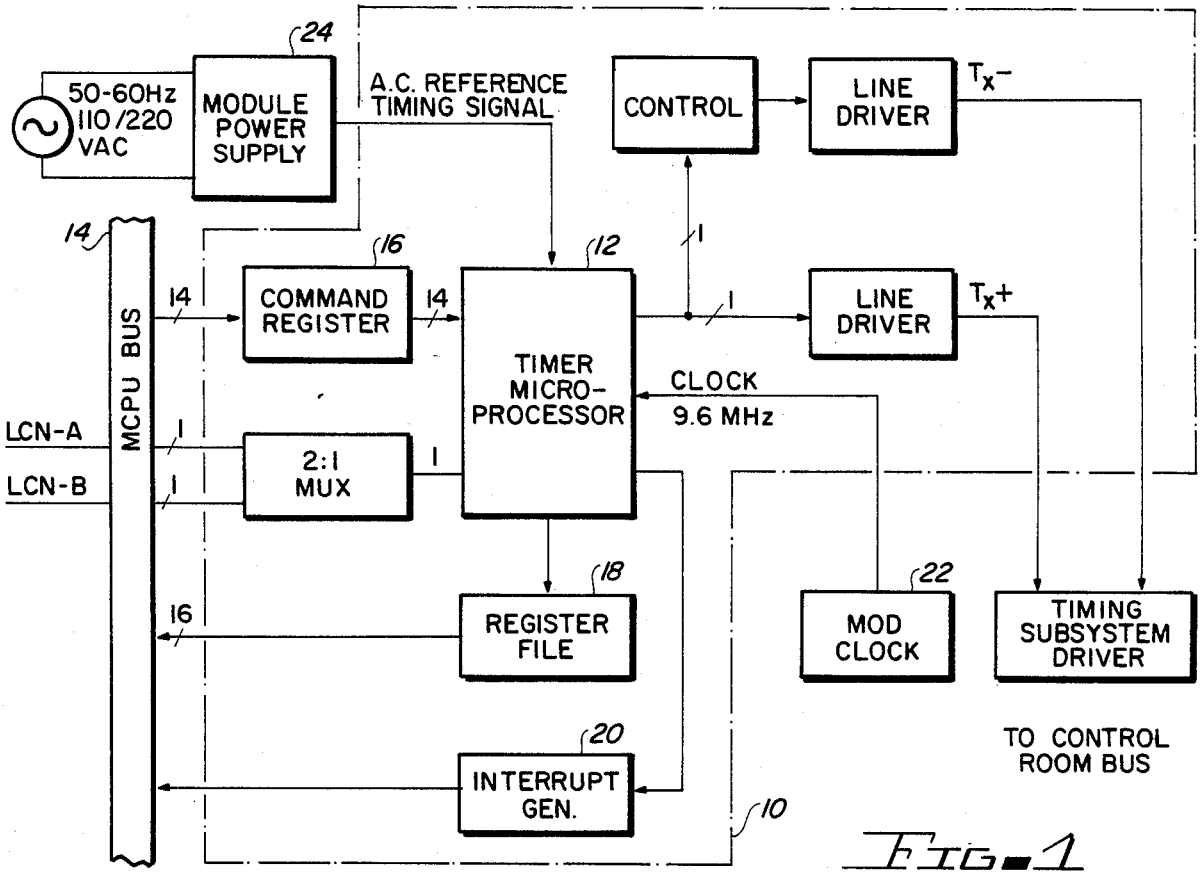
FIG. 1 is block diagram of digital timer, or timing subsystem, for practicing the method of this invention.

In FIG. 1, the subsystems of timer 10, which timer is capable of practicing the method of this invention, or illustrated. Timer 10, in the preferred embodiment, is the timing subsystem of a module control processor unit (MCPU)oof the invention described and claimed in concurrently filed patent aplication entitled METHOD AND APPARATUS FOR SYNCHRONIZING THE TIMING SUBSYSTEM OF THE PHYSSICAL MODULES OF A LOCAL AREA NETWORK BY DAVID L. KIRK, which application is assigned to Honeywell Inc., the assignee of this aplication, and disclosure of which is incorporated by reference into this application.

The key component, or subsystem of timer 10 is a single chip timer microprocessor 12, an Intel 8051 in the preferred embodiment. Timer microprocessor 12 receives commands and data from its accociated MCPU processor, which is not illustrated in FIG. 1, over the MCPU processor's local bus 14 by means of command register 16. Timer microprocessor 12 transmits information to its associated MCPU processor utilizing bus 14 and register file 18 and interrupt generator 20. For a complete description of all of the subsystems of timer 10, reference is made to the Kirk concurrently filed application identified above.

Applied to timer microprocessor 12 are clock pulses, or timing signals, from crystal controlled module clock 22. In the preferred embodiment, module clock 22 produces clock pulses having a frequency of $9.6\times10^6 H_z\pm0.05\%$. The other key input to microprocessor 12, for the purpose of this invention, if the A.C. reference timing signals which are produced by moduel power supply 24.

The frequency of the A.C. reference timing signals is a function of the source of A.C. electric power applied to moduel power supply 24 from a conventional source of electric power, such as an electric utility. The frequency of the A.C. power is normally either 50 $H_z$ or 60 $H_z$. In the preferred embodiment, the frequency of the A.C. reference timing signals produced by power supply 24 is twice that of the frequency of the A.C. power supply. Module power supply 24 also supplies D.C. power at appropriate voltages as required by the various subsystems and components of a physical module of which timer 12 is one. The other components of timer 10 illustrated in FIG. 1 are not used by timer 10 in practicing the methods of this inventions.

Figure 2:
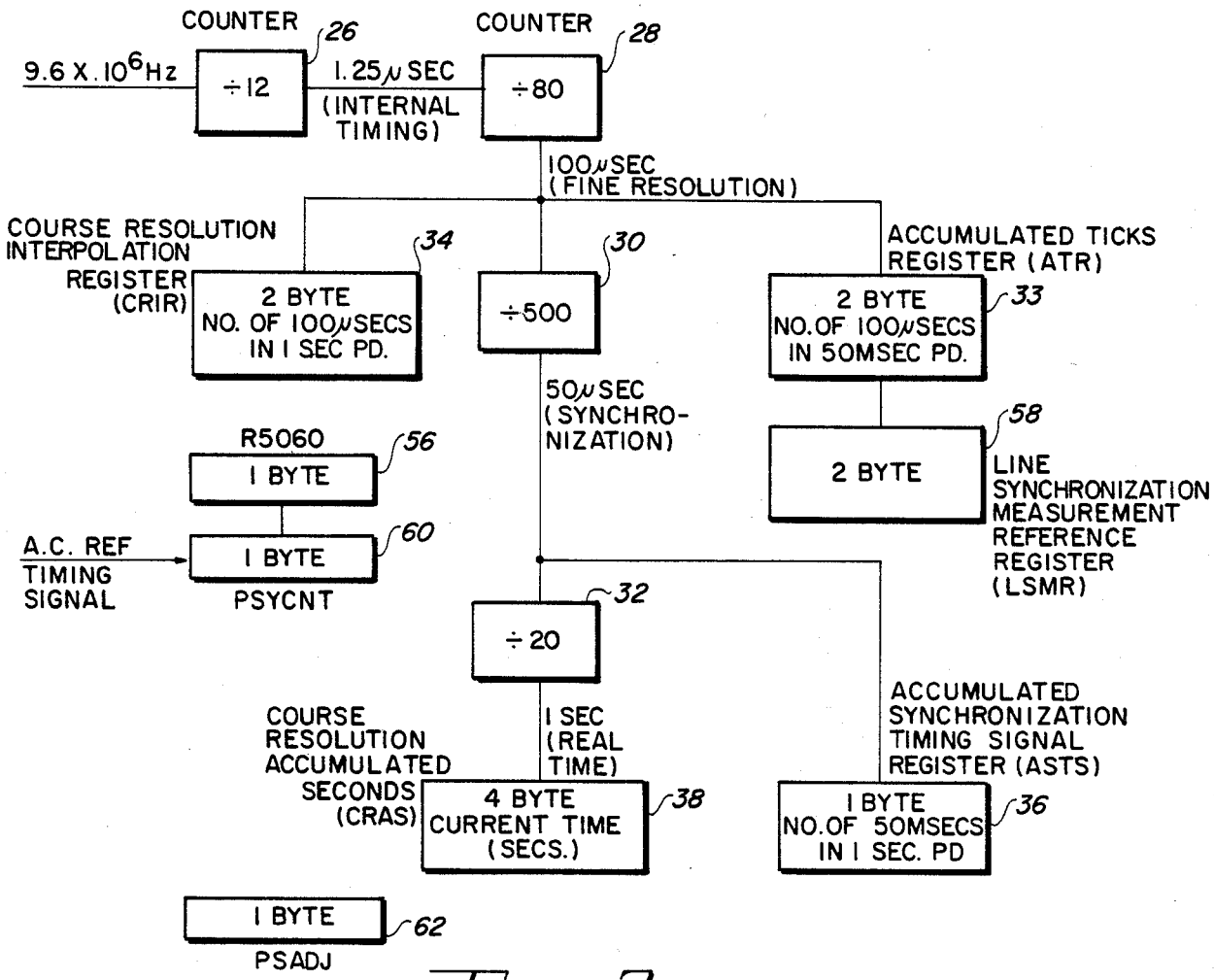
FIG. 2 is a schematic block diagram of the counters and registers of the digital timer of FIG. 1 utilized in practicing this invention.

Timer 12 maintains its own, or its internal sense of time. To do this microprocessor 12 performs certain operations and stores in designated registers its internal sense of time. In FIG. 2 the relationship between the various timing signals and how they are produced is illustrated. In addition, the internal registers of timer 12 utilized in the performance of this invention are also illustrated. Clock signals from module clock 22 having a frequency of $9.6\times10^6\pm0.05\%$ $H_z$, in the preferred embodiment, or divided by twelve by counter 26 to produce internal timing signals having a 1.25 microsecond ($\mu$ sec.) period. The 1.25 $\mu$ sec. internal timing signals are divided by timer counter 28 to produce fine resolution timing signals having a 100 $\mu$ sec. period. The 100 $\mu$ sec. fine resolution timing signals are in turn multipled by 500 by counter 30 to produce synchronization timing signals having a period of 50 milliseconds (m sec.). The 50 m sec. signals are multipled by twenty by counter 32 to produce real time timing signals having a period of one second.

The 100 $\mu$ sec. fine resolution signals from counter 28 are applied to accumulated ticks register (ATR) 33 and course resolution interpolation register (CRIR) 34. ATR 33 is a two byte register in which is stored the number of 100 $\mu$ sec. signals, or periods, in the present synchronization period of 50 m sec. CRIR is also a two byte register in which is stored the number of 100 $\mu$ sec. periods, or signals, in the present, or current, or one second period.

Synchronization timing signals produced by counter 30 are applied to accumulated synchronization timing signal (ASTS) register 36. ASTS register 36 is a one byte register in which are stored the number of 50 m sec. period, or synchronization timing signals, produced in the current one second period. One second, or real time, timing signals produced by counter 32 are applied to course resolution accumulated seconds (CRAS) register 38. CRAS register 38 s a four byte register in which is stored the current, or real time. This data constitutes the current time in terms of years, months, days, hours, minutes, and seconds of the current century expressed in seconds.

Figure 3:
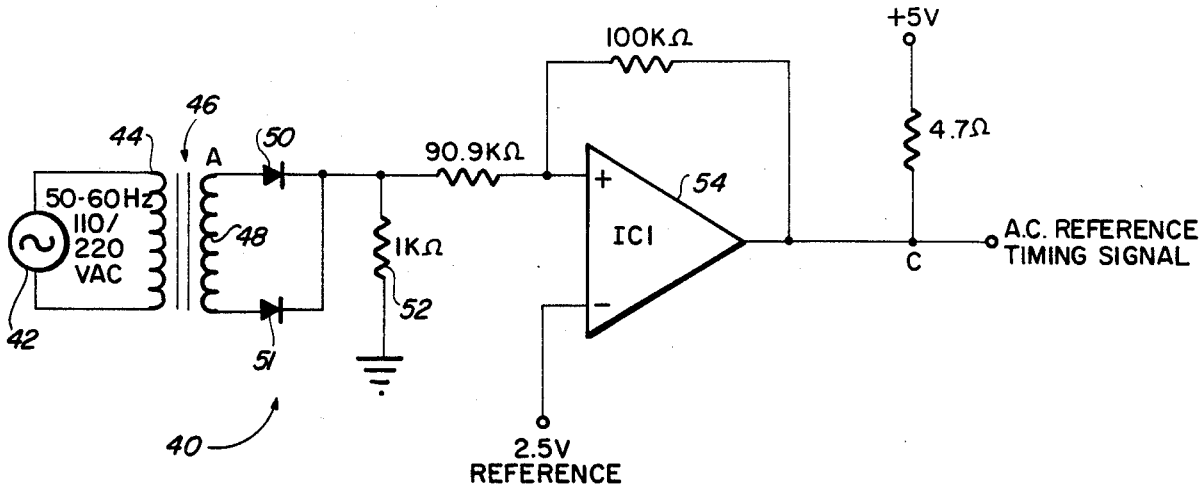
FIG. 3 is a diagram of a circuit for producing a A.C. reference timing signals.
Figure 4:
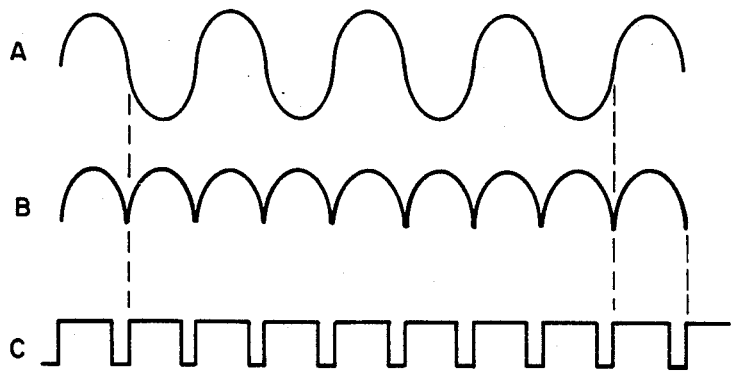
FIG. 4 illustrates wave forms used to describe the operation of the circuit of FIG. 3.

FIG. 3 is a diagram of A.C. reference timing generator circuit 40. Fifty or sixty cycle A.C. power from generator 42 at either 110 or 220 volts is applied across primary coil 44 of step down transformer 46. The wave form A illustrated in FIG. 4 is that of the voltage induced across the secondry winding, or coil, 48 of transformer 46. The frequency of this voltage is the same as that produced by generator 42. The voltage across coil 48 is full wave rectified by diodes 50 and 51 and produce the wave forms B as illustrated in FIG. 4 across resistor 52. The frequency of the voltage across resistor 52 is twice that of generator, or source, 42. The voltage across register 52 is applied to the noninverting input terminal of operational amplifier 54. The inverting input terminal of operational amplifier 34 is connected to a reference voltage source. Operational amplifier 54 produces as its output square waves C as illustrated in FIG. 4 the A.C. reference timing signal. The A.C. reference timing signal produced by circuit 40 has a frequency which is twice that of the source of an A.C. power applied to module power supply 24 and circuit 40.

Figure 5:
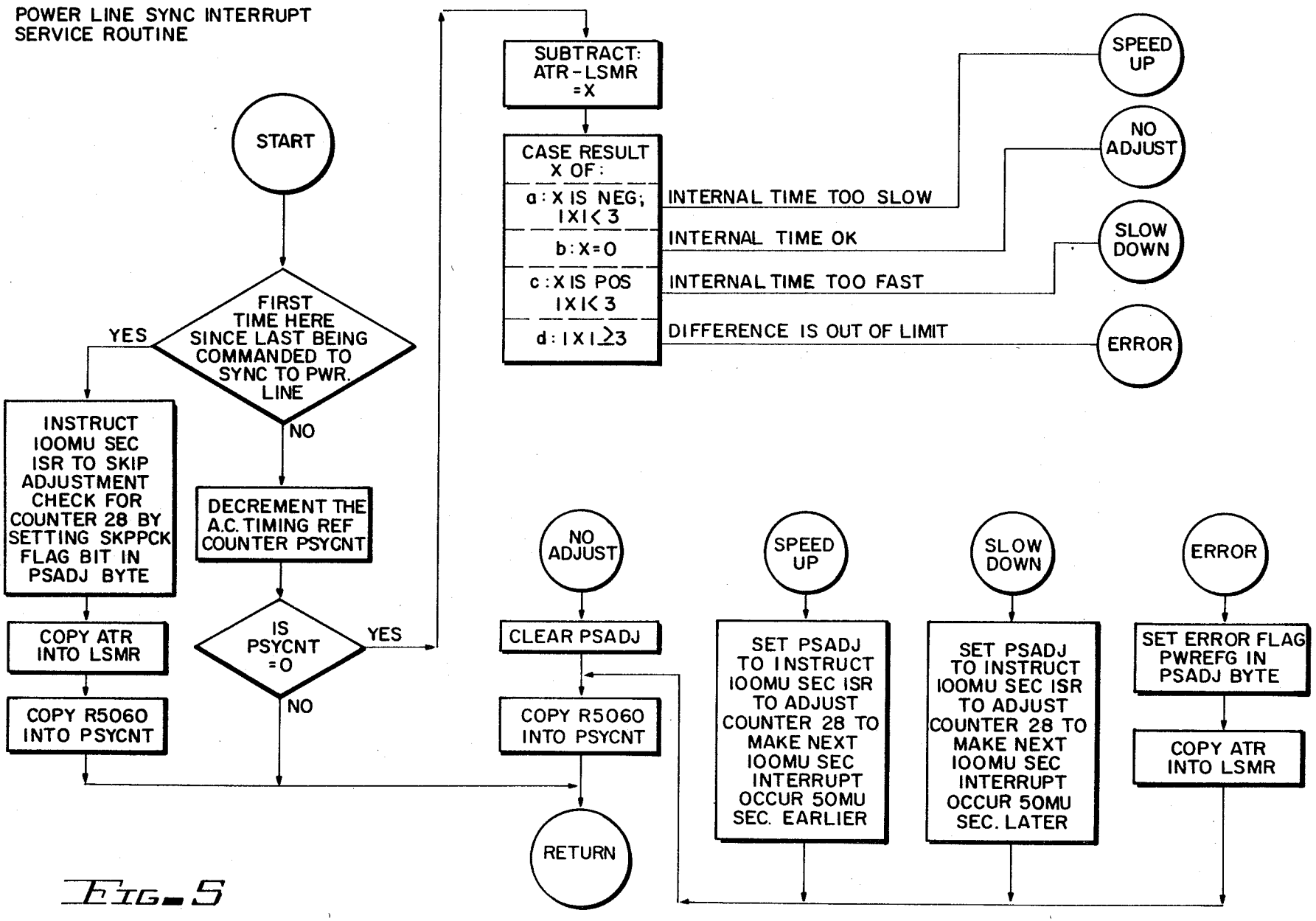
FIG. 5 is a flow chart of the method of this invention.

FIG. 5 is a flow chart of the power line synchronization interruput service routine (PLs ISR) program that is executed by timer microprocessor 12 on each high to low transition of an A.C. reference timing signal produced by circuit 40 after timer microprocessor 12 is commanded by a command transmitted to it through command register 16 to synchronize on the frequency of its source of A.C. power.

Upon initialization which occurs after power is first applied, or after a master/clear recovery command has been executed, timer microprocessor 12 determines the frequency of its power supply. To do this it counts the number of A.C. reference timing signals received, more particularly the number of high to low transitions of the A.C. reference timing signal received in a 50 m sec. period. The number so received will be 5 if the source of A.C. power is operating at 50 $H_z$ or 6 if it is operating at 60 $H_z$. This number is loaded into internal register 56 of timer microprocessor 12 designated as R5060. It is a one byte register.

When timer microprocessor 12 after initialization is commanded to synchronize to the frequency of its source of A.C. power, it enters into or starts executing its PLS ISR on each high to low transition of the A.C. reference timing signal. On the first entry into the program, the contents of ATR 32, the number of 100 $\mu$ sec. periods that have elapsed or occurred in the current 50 m se. period is written into line synchronization measurement reference (LSMR) register 58. LSMR register 58 is a two byte register. In addition, the contents of R5060 register 56 is copied into power synchronization counter (PSYCNT) 60. At the completion of these two actions, the PLS ISR returns to start and waits for the receipt of the next high to low transition of an A.C. refernece timing signal.

On the second such transition, and each such transition thereafter, timer microprocessor 12 enters or starts executing it's PLS ISR. The first action taken is to decrement PSYCNT 60 by 1 and to check to see if its contents are zero. If the contents of counter 60 are not zero, the program control is returned to the interrupted routine. Each time the contents of PSYCNT 60 equals zero, timer microprocessor 12 is commanded by the program to subtract the contents of LSMR 58 from that of ATR 32 to determine "X". If the absolute value of X is less than 3, the internal sense of time of timer microprocessor 12 is too slow if X is negative, is correct if zero, and too fast if X is positive. If the absolute value of X is $\geqq 3$, an error is deemed to have occurred.

If X is negative and less than 3, timer microprocessor 12 sets power synchronization adjustment (PSADJ) register 62 to instruct timer 12's 1000 $\mu$ sec. Interrupt service routine (ISR) to adjust counter 28 to produce the next 100 $\mu$ sec. signal 50 $\mu$ sec. earlier and the contents of R5060 register 56 are copied into PSYCNT 60. When these steps are completed, the PLS ISR returns to the interrupted progrm. If X is positive and less than 3, the PLS ISR causes PSADJ register 62 to be set to instruct the 100 $\mu$ sec. ISR to adjust counter 28 to produce the next 100 $\mu$ sec. signal 50 $\mu$ sec. later, the contents of R5060 register are copied into PSYCNT 60, and the PL ISR returns to the interrupted program until the receipt of the next A.C. reference timing signal.

I $X=0$, PSADJ 62 is cleared and no adjustment is made to counter 28 by the 100 $\mu$ sec. ISR. The contents of R5060 are loaded into PSYCNT 60 and the PLS ISR returns to interrupted program until the receipt of the next A.C. reference timing signal.

If the absolute values of $X\geqq$ or exceeds 3, the PLS ISR causes an error flag bit PWRFG of PSADJ register 62 to be set. The contents of ATR 32 are copied into LSMR register 58, and the contents of R5060 are copied into PSYCNT 60. PLS ISR then returns to the interrupted program. If three error conditions, i.e. $1X1\geqq 3$ occur in any one second period, PLS ISR will be disabled and will remain so until timer microprocessor 12 is again commanded to synchronize on the frequency of its source of A.C. power.

The PLS ISR checks to determine that every 5th A.C. reference timing signal for 50 $H_z$ A.C. power or 6th A.C. reference timing signal or 60 $H_z$ A.C. power occurs at the same relative time within each 50 m sec. cycle, or period, $\pm 200$ $\mu$ sec. If the fifth of sixth A.C. reference timing signal occurs within the required $\pm 200$ $\mu$ sec. window, a speed up or slow down indicator is set or cleared in PSADJ register 62. This information is used by the 100 $\mu$ sec. ISR to adjust counter 28 by effectively adding or substracting 50 $\mu$ sec. to counter 28 to speed up or slow down the production of the next 100 $\mu$ sec. timing signal. If no adjustment is required none is made. If the fifth or sixth A.C. timing reference timing signal is not received within the required window, an error flag is set in PSADJ register 62 and no adustment is made to timer 28.

In FIG. 2 the registers of timer microprocessor 12 utilized in practicing the method of this invention are illustrated. In the preferred embodiment addressable memory locations of the internal random access memory of microprocessor 12 are used as registers.

From the foregoing it is believed obvious that this invention provides a method of synchornizing a digital timer to the frequency of a source of A.C. electric power to permit the timer to maintain its internal sense of time very accurately over long periods of time with the minimum of complexity and cost.

It should be evident that various modifications can be made to the described method without departing from the scope of the present invention.

What is claimed is:

1. The method of synchronizing a digital timer with the frequency of a source of A.C. power, said timer producing internal, fine resolution, synchronization and real time, timing signals, the periods of the fine resolution, synchronization and real time timing periods being integral multiples of the period of the internal timing signal, said method comprising the steps of:

1. determining the frequency of the source of the A.C. power;
2. producing A.C. reference timing signals, the frequency of which is a function of the frequency of the source of A.C. power, the periods of the synchronization timing signals being divisible a predetermined integral number of times by the period of the A.C. reference timing signals;
3. comparing the number of fine resolution signals produced in each synchronization period with the number of fine resolution timing signals produced in an earlier synchornization period when said predetemined integral number of A.C. timing signal is produced in each of said synchornization periods; and
4. adjusting the time at which fine resolution timing signals are produced as required to maintain substantially constant the number of fine resolution timing signals in each synchronization period at which the predetermined A.C. reference timing signal is produced in each such synchronization period.

2. The method of claim 1 which further includes the step of declaring an error condition if the absolute value of the difference sensed as the result of performing step 3 equals or exceeds a first predetermined amount.

3. The method of claim 2 which further includes the step of terminating the method if the number of error conditions declared in any given real time timing period exceeds a second predetermined amount.

4. The method of synchronizing a digital timing system with the frequency of an A.C. power source, the timing system including a first register which stores the number of fine resoltuion timing signals that have been produced in a synchronization period and a first counter which produces fine resolution timing signals from internal timing signals, said timing system having a source of A.C. reference signals having a frequency that is a function of the A.C. power source, said method comprising the steps of:

A. upon initialization;
   1. counting the A.C. timing signals produced in a synchronization period;
   2. storing the count of step 1 in a second register;

B. said timing system, when commanded to synchronize with the frequency of its A.C. power source, on the receipt of the first reference timing signal thereafter;
   3. copying the contents of the first register into a third register; and
   4. copying the contents of the second register into a second counter; and C. on the receipt of each A.C. reference timing signal after said first;
   5. decrementing the second counter by one;
   6. determining if the count of the second counter is zero;
   7. subtracting the contents of the third register from that of the first register to determine X each time the count of the second counter is zero;
   8. adjusting the first counter to cause the next fine resolution timing signal to be produced earlier if X is negative and has an absolute value of less than "m";

9. making no adjustment to the first counter if X equals zero;

10. delaying the production of the next fine resolution timing signal if X is positive and has an absolute value of less than "m";

11. producing an error signal, and copying the contents of the first register into the third register; if the absolute value of X equals or exceeds m;

12. copying the contents of the second register into the second counter at the completion of steps 9, 10, 11, or 12; and 13. repeating the process beginning at step 5.

5. The method of claim 4 which further includes the step of terminating the method if the number of error signals produced in a one second period exceeds a predetermined number.

6. The method of claim 5 in which the frequency of the A.C. reference timing signals is twice the frequency of the A.C. power source.

7. The method of claim 6 in which m equals three.

8. The method of synchronizing a digital timer with the frequency of a source of A.C. power, said timer producing internal, fine resolution, synchronization and real time, timing signals, the periods of the fine resolution, synchronization and real time timing periods being integral multiples of the period of the internal timing signal, said method comprising the steps of:

1. determining the frequency of the source of the A.C. power;

2. producing A.C. reference timing signals, the frequency of which is a function of the frequency of the source of A.C. power, the quotient of dividing the period of a synchronization timing signal by a period of an A.C. reference timing signal being "n" where n is an integer greater than zero;

3. comparing the numbr of fine resolution signals produced in each syncronization period when the $n^{th}$ A.C. reference timing signal is produced in each of said synchronization periods with the number of fine resolution timing signals produced in a reference synchronization period; and 4. adjusting the time at which fine resolution timing signals are produced to maintain substantially constant the number of fine resolution timing signals in each synchronization period at which the $n^{th}$ A.C. reference timing signal is produced.

9. The method of claim 8 which further includes the step of declaring an error to exist if the absolute value of the difference as the result of performing step 3 of claim 8 equals or exceeds "a".

10. The method of claim 9 which further includes the step of terminating the method of the number of errors declared is a given real time period equals "b".

11. The process of claim 10 in which n=5 if the frequency of the source of A.C. power is 50 $H_z$ and 6 if the frequency of the source of A.C. power is 60 $H_z$.

12. The process of claim 11 in which "a" equals three and "b" equals three.

13. The method of synchronizing a digital timing system with the frequency of an A.C. power source, the timing system including an automatic ticks register (ATR) which stores the number of 100 $\mu$ sec. timing signals that have been produced in a 50 m sec. period and a fine resolution counter which produces 100 $\mu$ sec. fine resolution timing signals from 1.25 $\mu$ sec. internal timing signals, said timing system having a source of A.C. timing signals having a frequency twice that of the A.C. source power source, said method comprising the steps of:

A. upon initialization;

1. counting the A.C. timing signals produced in a 50 m sec. period;

2. storing the count of step 1 in a register designated R5060;

B. said timing system when commanded to synchronize itself with the frequency of its A.C. power source and on the first high to low transition of an A.C. reference timing signal thereafter;

3. copying the contents of the ATR register into a line synchronization measurement register (LSMR); and 4. copying the contents of the R5060 into a power line synchronization counter (PSYCNT); and C. on each high to low transition of an A.C. reference timing signal after said first;

5. decrementing the PSYCNT counter by one;

6. determining if count of the PSYCNT counter is zero;

7. subtracting the contents of the LMSR from that of the ATR to determine X each time the count of the PSYCNT counter is zero;

8. adjsuting the fine resolution counter to cause the next 100 $\mu$ sec. timing signal to be produced 50 $\mu$ sec. earlier if X is negative and has an absolute value of less than three;

9. making no adjustment to the fine resolution counter if X equals zero;

10. delaying the production of the next 100 $\mu$ sec. timing signal by the fine resolution counter by 50 $\mu$ sec. if X is positive and has a value of less than three;

11. producing an error signal, and copying the contents of the ATR into the LMSR; if the absolute value of X is equal or exceeds 3;

12. copying the contents of R5060 into the power line synchronization counter at the completion of steps 9, 10, 11, or 12; and 13. repeating the process beginning at step 5.

14. The method of claim 13 further including the step of terminating the method if the number of error signals produced in a one second period equals or exceeds three.

* * * * *

UNITED STATES PATENT AND TRADEMARK OFFICE

CERTIFICATE OF CORRECTION

PATENT NO. : 4,583,865

DATED : Apr. 22, 1986

INVENTOR(S) : David L. Kirk; Robert L. Spiesman

It is certified that error appears in the above—identified patent and that said Letters Patent is hereby corrected as shown below:

On the first page, section [73] cancel "Honeywell, Phoenix, Ariz. and substitute --Honeywell Inc., Minneapolis MN--

Signed and Sealed this

*Sixteenth* Day of *September 1986*

[SEAL]

*Attest:*

DONALD J. QUIGG

*Attesting Officer*

*Commissioner of Patents and Trademarks*